United States Patent [19]

Weindel et al.

[11] 4,448,413

[45] May 15, 1984

[54] AMUSEMENT GAME DEVICE

[75] Inventors: David Weindel, 106 Forge Rd., East Greenwich, R.I. 02818; Carl Cederholm, Lincoln, R.I.

[73] Assignee: David Weindel

[21] Appl. No.: 463,384

[22] Filed: Feb. 3, 1983

[51] Int. Cl.[3] ..... A63F 7/00; A63F 9/14

[52] U.S. Cl. ..... 273/1 GB; 46/123; 414/7

[58] Field of Search ..... 273/1 GA, 1 GB, 85 R; 46/123, 124, 40; 414/1, 7

[56] References Cited

U.S. PATENT DOCUMENTS

| | | | |
|---|---|---|---|
| 1,858,020 | 5/1932 | Linke | 273/1 GB X |
| 3,159,400 | 12/1964 | Brass et al. | 273/1 GA |
| 3,497,083 | 2/1970 | Anderson et al. | 46/40 X |
| 3,712,617 | 1/1973 | Ohlschlager | 273/1 GB |
| 4,106,768 | 8/1978 | Kanno | 273/1 GB |
| 4,236,718 | 12/1980 | Kaga | 273/1 GB X |

FOREIGN PATENT DOCUMENTS

| | | | |
|---|---|---|---|
| 139849 | 1/1953 | Sweden | 46/123 |
| 901135 | 7/1962 | United Kingdom | 46/124 |

*Primary Examiner*—Paul E. Shapiro

*Attorney, Agent, or Firm*—Salter & Michaelson

[57] ABSTRACT

An amusement game device includes a labyrinth structure and a pair of elongated resiliently flexible substantially coextensive strips which are interconnected at one end thereof. The device is operable to effect the selective independent longitudinal advancement and retraction of each of the strips to cause the interconnected ends thereof to be selectively turned and thereby guided through the labyrinth structure. Game play is effected by advancing the strips through the labyrinth structure to engage and manipulate or retrieve game elements positioned therein through the use of a magnet or the like attached to the interconnected strip ends.

14 Claims, 10 Drawing Figures

FIG. 3
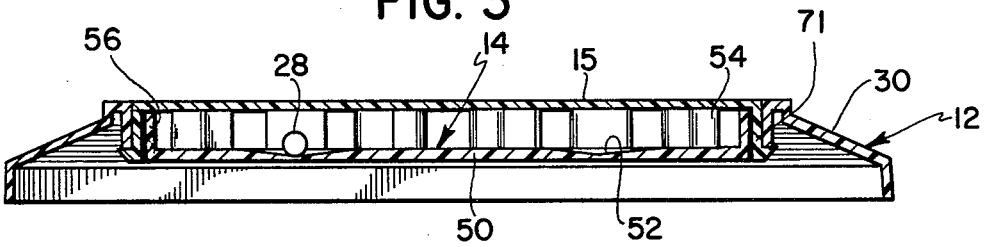
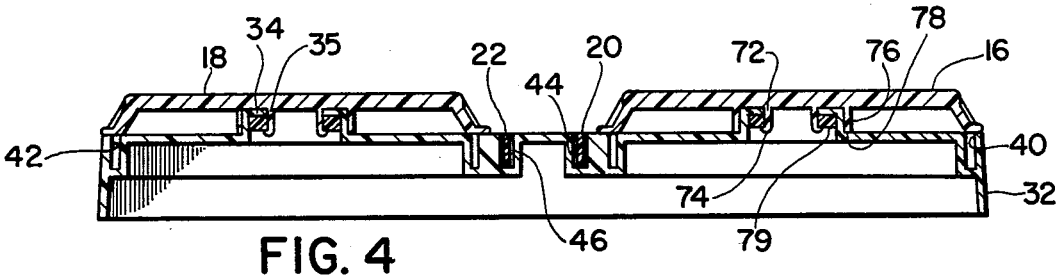
FIG. 4
FIG. 5
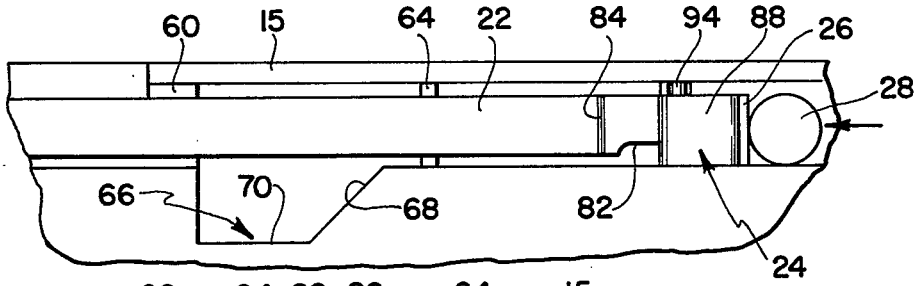
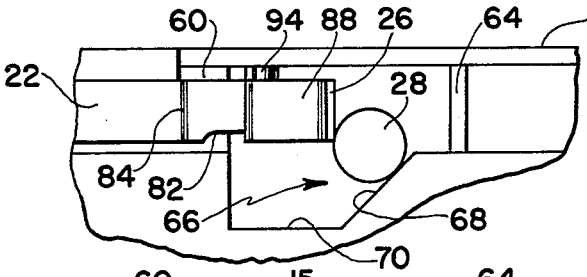
FIG. 6
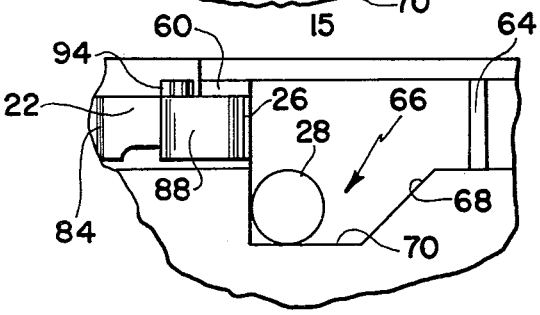
FIG. 7
FIG. 8
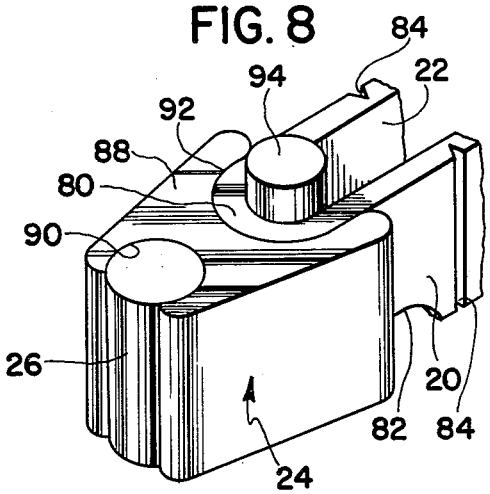

AMUSEMENT GAME DEVICE

BACKGROUND AND SUMMARY OF THE INVENTION

The instant invention relates to amusement games and more particularly to a novel maze or labyrinth amusement game device.

The concept of embodying a maze or labyrinth structure in an amusement game device is generally known in the prior art. In this regard, the U.S. patents to Ohlschlager, U.S. Pat. Nos. 3,712,617, and Kaga, 4,236,718, are exemplary and represent the closest prior art to the instant invention of which the applicant is aware. However, while the overall concept of providing a labyrinth type amusement game device is generally known, the device of the instant invention represents a significant advancement over the heretofore known labyrinth game devices as a result of its unique operation and structure. Specifically, the device of the instant invention includes a pair of resiliently flexible elongated substantially coextensive strips which may be independently advanced and/or retracted by game players to guide the outwardly extended portions of the strips through a labyrinth structure in the device. Accordingly, through the proper manipulation of the strips they can be guided to game elements in the labyrinth structure to engage and manipulate or retrieve the game elements. The concept of providing a game device of this type is neither shown nor taught in the prior art.

The game device of the instant invention includes a base and a game board attached to the base having a plurality of labyrinth elements which extend upwardly thereon to define a labyrinth structure. A pair of resiliently flexible elongated strips, at least the terminal portions of which are substantially coextensive, are included in the device and means are provided attached to the base for independently longitudinally advancing and retracting each of the strips. Guide elements are provided on the base for guiding the strips from the advancing and retracting means to the board whereby substantially longitudinal advancement of the strips can be effected without substantial outward bending or bulging thereof. Accordingly, by manipulating the advancing and retracting means, the strips can be directed through the labyrinth structure to engage and manipulate or retrieve game elements positioned on the game board.

The game device of the instant invention can be effectively used in a variety of different amusement games by one or more game players. In this connection, individual game players can find amusement by manipulating the strips to guide or weave them through the labryinth elements to engage and manipulate or retrieve game elements on the board. The device can also be embodied with pairs of the coextensive strips extending from advancing and retracting means at the opposite ends of the board whereby a pair of game players can compete for game elements on the board. In any case, the game device can be effectively used to capture the attention of game players as a result of its unique operation and structure and, therefore, the device has substantial amusement value. The device can also aid in the development of hand to eye coordination of game players and requires strategy and skill in its use and operation.

Accordingly, it is a primary object of the instant invention to provide an amusement game device wherein a pair of resiliently flexible elongated strips are directed through a labyrinth structure by the selective, independent longitudinal advancement or retraction of each of the strips.

Another object of the instant invention is to provide a labyrinth game device wherein game players manipulate pairs of elongated resiliently flexible stips to retrieve game elements.

A still further object of the instant invention is to provide a novel labyrinth amusement game device.

Other objects, features and advantages of the invention shall become apparent as the description thereof proceeds when considered in connection with the accompanying illustrative drawings.

DESCRIPTION OF THE DRAWINGS

In the drawings which illustrate the best mode presently comtemplated for carrying out the present invention:

FIG. 3 is a sectional view taken along line 3—3 in FiG. 2;

FiG. 4 is a sectional view taken along line 4—4 in FIG. 2;

FIGS. 5–7 are fragmentary sectional views illustrating the sequential operation of the device to effect the disengagement of a game element from the magnet on the interconnected ends of a pair of strips;

FIG. 8 is a fragmentary perspective view of a magnet head on the interconnected ends of a pair of the strips;

DESCRIPTION OF THE INVENTION

Figure 1:
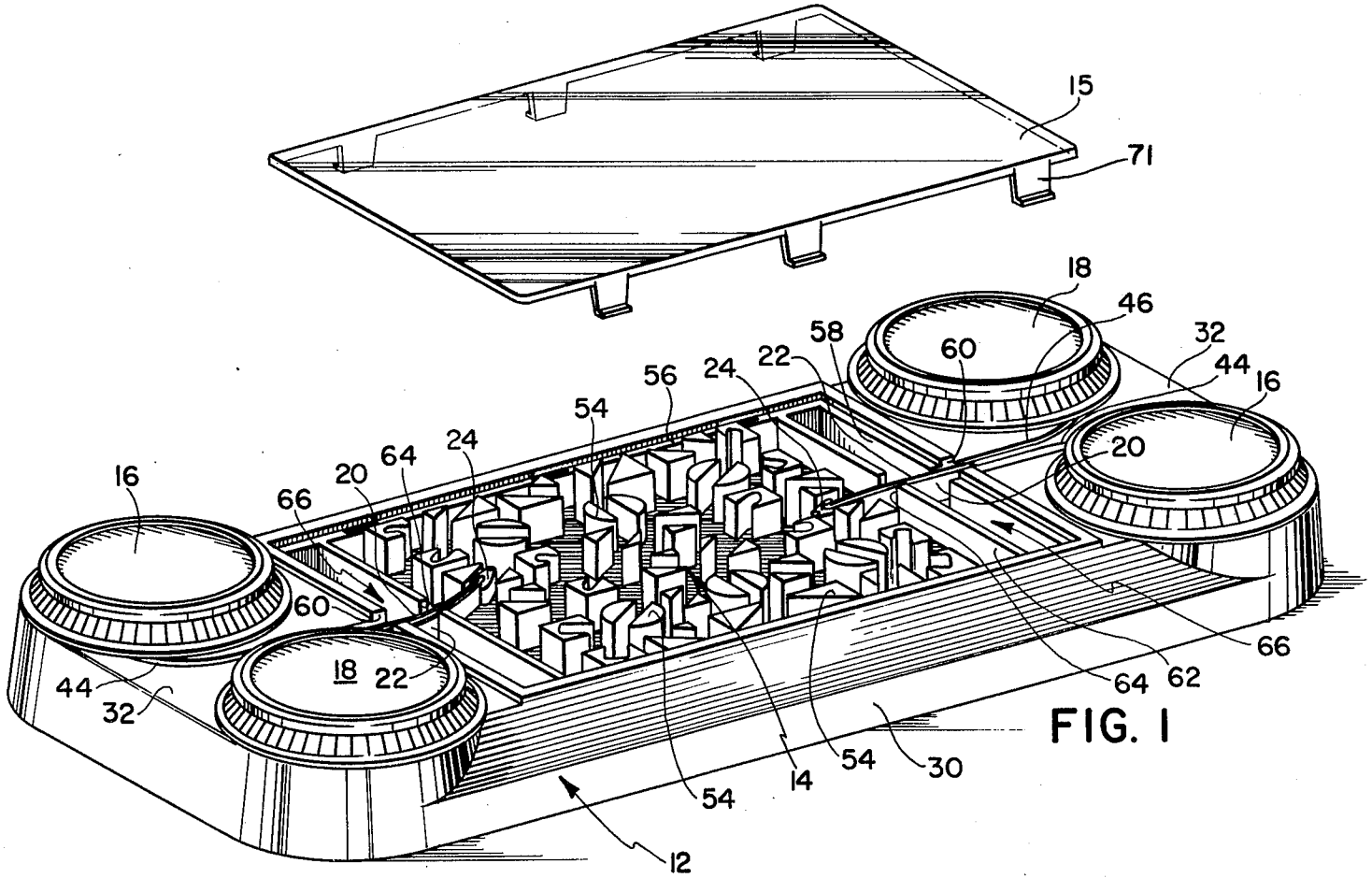
FIG. 1 is a perspective view of the game apparatus with the transparent cover plate thereof in exploded relation.
Figure 2:
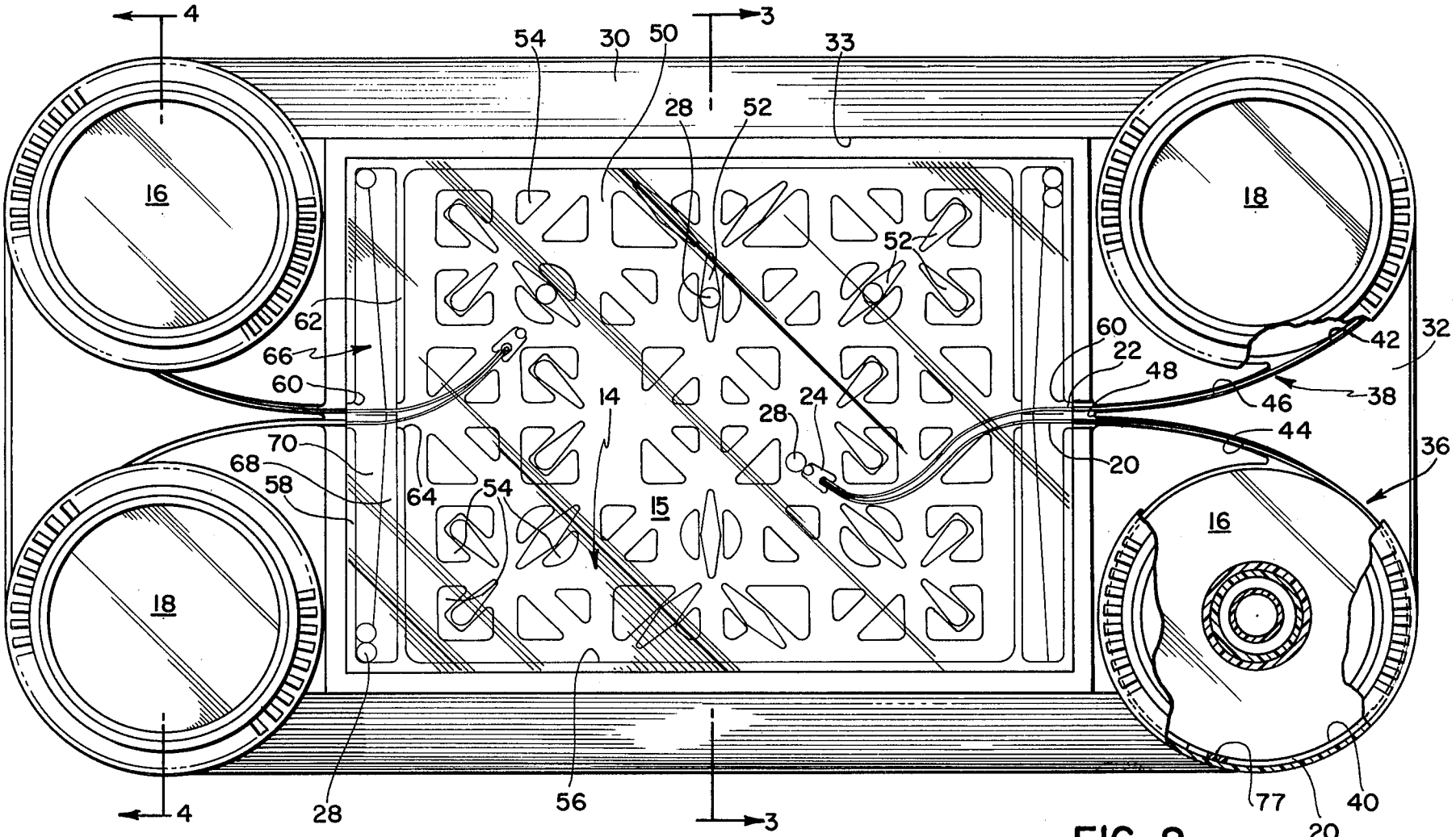
FIG. 2 is a top plan view of the game apparatus.

Referring now to the drawings, the amusement game device of the instant invention is illustrated and generally indicated at 10 in FIGS. 1 and 2. The game device 10 comprises a base generally indicated at 12, a game board generally indicated at 14 which is mounted on the base 12, a transparent cover plate 15 which covers the board 14, two pairs of first and second dial elements 16 and 18, respectively, which are mounted on the base 12 at opposite ends of the game board 14, and two pairs of first and second elongated resiliently flexible strips 20 and 22, respectively, which are interconnected at one end thereof and which extend from the dial elements 16 and 18, respectively, at the opposite ends of the board 14. A magnet head 24 containing a magnet 26 is secured to the interconnected ends of each of the pairs of strips 20 and 22 and a plurality of magnetically attractive substantially spherical game elements 28 are provided on the board 14. Accordingly, operation of the game device 10 is effected by manipulation of the dial elements 16 and 18 to advance and retract the respective strips 20 and 22 attached thereto whereby the pairs of strips 20 and 22 with the respective heads 24 thereon can be directed across the board 14 to engage the game elements 28 with the magnets 26. However, it will be understood that the embodiment of the device of the instant invention without the magnets 26 wherein the interconnected strip ends are used to manipulate game elements or other members rather than to retrieve game elements is also contemplated.

The base 12 is preferably formed as a hollow, generally rectangular structure which is integrally molded from a suitable rigid plastic material such as a polystyrene. As herein embodied, the base 12 comprises a pair of side portions 30 and a pair of end portions 32 which are interconnected by the side portions 30 and which cooperate therewith to define a substantially rectangular open interior area 33 wherein the game board 14 is received and secured. Provided in each of the end portions 32 are upstanding hubs 34 having apertures 35 therein. Also provided in the end portions 32 are recessed slots 36 and 38 which comprise substantially circular coiling portions 40 and 42, respectively, which are concentric with the hubs 34, and arcuate guide portions 44 and 46, respectively, which diverge from the respective coiling portions and terminate in closely spaced relation with each other and in communication with the open area 33 as at 48. The slots 36 and 38 are dimensioned to slidingly receive the strips 20 and 22, respectively, as will hereinafter be more fully set forth.

The game board 14 is most clearly illustrated in FIGS. 1 and 2 and includes a bottom wall 50 having a plurality of shallow recesses 52 therein and a plurality of maze or labyrinth elements 54 of various configurations which extend upwardly from the botton wall 50 in spaced relation and define a labyrinth structure on the board 14. The periphery of the board 14 is defined by upstanding side walls 56 and upstanding end walls 58, the end walls 58 having openings 60 therein which communicate with the slots 36 and 38. Spaced inwardly from the end walls 58 are partitions 62 having openings 64 therein which are aligned with the openings 60, the partitions 62 cooperating with the end walls 58 to define troughs 66 at the opposite ends of the game board 14. As will be noted from FIGS. 2, 5, 6 and 7, the portions of the bottom wall 50 which are within the confines of the troughs 66 include surfaces 68 which are downwardly inclinded towards the respective ends of the board 14 and recessed channels 70 which are defined by the respective surfaces 68 and the respective end walls 58 and which are slightly downwardly inclined towards the opposite sides of the game board 14. The cover 15 which includes mounting feet 71 is mounted on the base 12 so that the feet 71 engage the side portions 30 and so that it abuts the upper ends of the labyrinth elements 54 as illustrated in FIG. 3.

Figure 9:
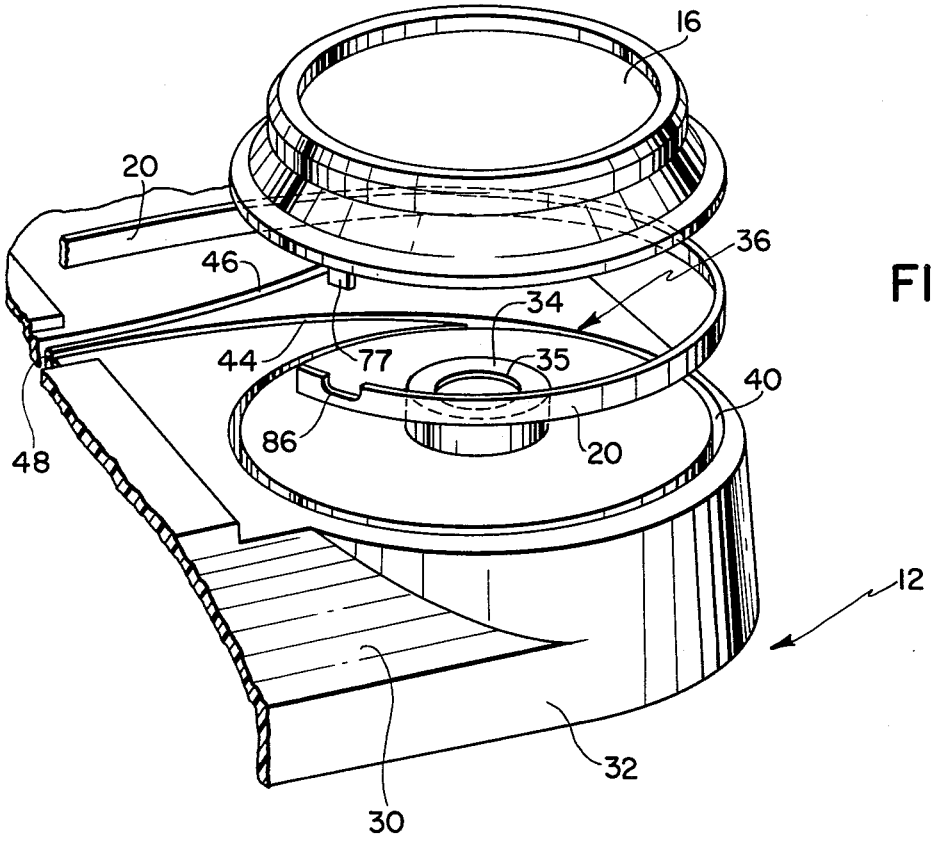
FIG. 9 is a fragmentary exploded perspective view of one end of the device.

The dial elements 16 and 18 are preferably integrally molded of a suitable rigid plastic material in the substantially circular fluted configurations illustrated so that they are easily manipulated by game players during use of the device 10. As illustrated in FIG. 4, a tubular neck portion 72 having an outwardly flared end 74 extends downwardly from the central portion of each of the dial elements 16 and 18 and a sleeve portion 76 extends downwardly from each of the dial elements 16 and 18 in substantially concentric relation with the respective neck portion 72. As illustrated in FIG. 9, a tab or tooth 77 extends downwardly from each of the dial elements 16 and 18 adjacent the outer periphery thereof. The dial elements 16 and 18 are assembled on the end portions 32 as illustrated in FIGS. 4 and 9 so that the neck portions 72 are received in the apertures 35 in the hubs 34 and so that the sleeve portions 76 surround the hubs 34 and bear on the end portions adjacent the hubs 34 as at 78. Washers 79 are provided on the inner sides of the hubs 34 and are engaged by the ends 74 to retain the dial elements 16 and 18 in rotatable relation on the end portions 32. When the dial elements 16 and 18 are mounted in this manner they are rotatable on the base 12 with the teeth 77 traveling in the respective coiling portions 40 and 42.

Figure 10:
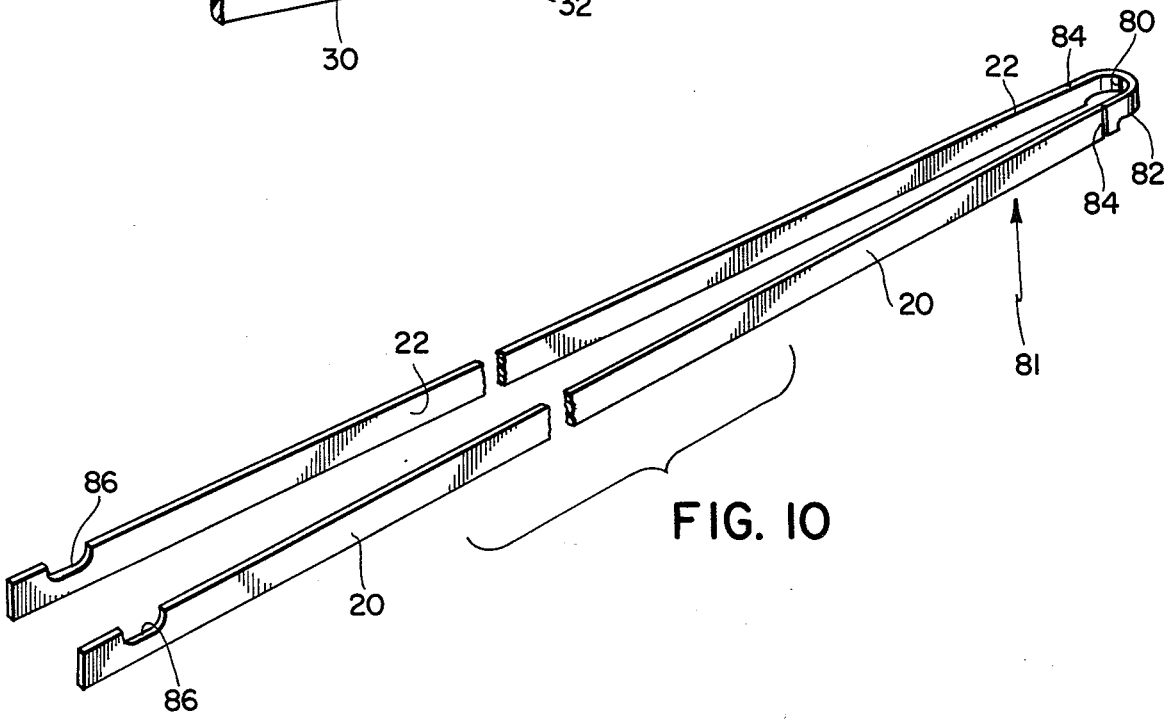
FIG. 10 is a perspective view of a pair of the interconnected strips.

The strips 20 and 22 are preferably made of a suitable resiliently flexible plastic material such as low density polyethylene and are preferably integrally interconnected at the outer ends thereof as at 80 whereby the two strips 20 and 22 cooperate to define a single strip which is generally indicated at 81 in FIG. 10. A downwardly facing notch 82 is provided in the strip 81 where the strips 20 and 22 are interconnected to provide an area of reduced cross section for increased flexability and score lines 84 which are disposed adjacent the notch 82 are provided for similar reasons. Upwardly facing notches 86 are provided adjacent the opposite extremities of the strip 81 as illustrated. The interconnected strips 20 and 22 are received in slots 36 and 38, respectively, and extend outwardly from the guide portions 44 and 46, respectively, in substantially coextensive relation. The teeth 77 are received in the notches 86 to interconnect the dial elements 16 and 18 to the strips 20 and 22, respectively, whereby manipulation of the dial elements 16 and 18 causes corresponding advancement or retraction of the strips 20 and 22, respectively, in the slots 36 and 38, respectively.

As shown most clearly in FIG. 8, the magnet heads 24 comprise slightly resiliently flexible plastic base members 88 having elongated arcuate grooves 90 in the front ends thereof wherein the magnets 26 are snap received and having enlarged elongated arcuate grooves 92 on the rear ends thereof. Pins 94 are received between the interconnected ends of the strips 20 and 22, and the interconnected ends, together with the pins 94, are snap-received in the grooves 92 to assemble the respective heads 24 to the strips 20 and 22.

In use and operation of the device 10, the strips 20 and 22 are first retracted by manipulating the dial elements 16 and 18 to coil the strips 20 and 22 in the respective coiling portions 40 and 42 so that the heads 24 are withdrawn into the openings 60. Thereafter the device 10 is tilted so that all of the game elements 28 are removed from the troughs 66 and pass through the openings 64 onto the central or labyrinth portion of the game board 14. The device 10 is then positioned on a substantially level supporting surface whereupon the game elements 28 normally gravitate into the recesses 52. Thereafter, the game is commenced with game players at opposite ends of the device 10 manipulating the appropriate pairs of dial elements 16 and 18 to maneuver the respective heads 24 attached thereto between the labyrinth elements 54. Specifically, it will be seen that by manipulating the dial elements so that one of the strips 20 and 22 is advanced a slightly greater amount than the other, the respective head 24 can be caused to turn in an arcuate path in the general direction of the lesser advanced strip to direct the head 24 between the labyrinth elements 54 as desired. The notch 82 and the scorelines 84 enhance this action by providing areas of increased flexibility in the strips 20 and 22 adjacent the outer ends thereof where the head 24 is attached thereto so that bending occurs primarily in the end portions of the strips. Accordingly, the heads 24 can be directed between the labyrinth elements 54 to the game elements 28 whereupon the elements 28 are magnetically attracted to the magnets 26 so that the elements 28 can be retracted with the strips 20 and 22. In this regard, as the strips 20 and 22 are advanced and retracted, the guide portions 44 and 46 guide them to effect substantially longitudinal advancement and retraction thereof across the end portions 32 without substantial outward bending or bulging. In addition, since the labyrinth elements 54 are disposed in relatively closely spaced relation on the board 14 they cooperate to maintain the outwardly extended portions of the strips 20 and 22 in substantially coextensive relation without substantial outward bending thereof on the board 14. Accordingly, the substantially longitudinal advancement and retraction of the strips 20 and 22 can be effected by manipulating the dial elements 16 and 18 to accurately direct the respective heads 24 between the labyrinth elements 54. The cover 15 functions to downwardly retain the strips 20 and 22 on the board 14 as they are moved thereacross. As the strips 20 and 22 are retracted, they are progressively coiled in the coiling portions 40 and 42 and the head 24, magnet 26 and game element 28 attached thereto are drawn into the respective trough 66.

As illustrated sequentially in FIGS. 5, 6 and 7, after a game element 28 has been retrieved with a pair of the strips 20 and 22 it is disengaged from the respective magnet 26 and falls into the respective channel 20. Specifically, as the respective magnet 26 is retracted into the respective opening 60, the element 28 attached to the magnet 26 falls into the respective channel 70 and gravitates outwardly towards a side of the board 14. The game player may then readvance the respective strips 20 and 22 to once again direct the respective head 24 through the labyrinth elements 54 to engage and capture another game element 28. This procedure may be followed until all the game elements 28 have been positioned in the troughs 66 whereupon the game player who has secured the greatest number of elements 28 is declared the game winner. It will be understood, however, that the device 10 can also be used in a variety of other similar amusement games.

It is seen, therefore, that the instant invention provides an amusement game device which can effectively capture the attention of game players for extended periods of time. In order for a game player to be successful the player must exercise a substantial degree of skill and strategy. In this regard, it will be obvious that a game player's success will depend on his or her skill at weaving the respective head 24 through the labyrinth elements 54 as well as his or her judgement in selecting the proper path through the labyrinth elements 54 to arrive at a particular game element 28. It is apparent, therefore, that the device 10 has substantial entertainment and amusement value and also functions to improve the hand to eye coordination of the players. For these reasons the instant invention represents a significant advancement in the amusement game art which has substantial commercial merit.

While there is shown and described herein certain specific structure embodying this invention, it will be manifest to those skilled in the art that various modifications and rearrangements of the parts may be made without departing from the spirit and scope of the underlying invention concept and that the same is not limited to the particular forms herein shown and described except insofar as indicated by the scope of the appended claims.

What is claimed is:

1. An amusement game device comprising:

a. a base;

b. a game board on said base;

c. a game element on said board;

d. first and second resiliently flexible elongated strips having spaced inner and interconnected outer ends;

e. means attached to said base and communicating with said first and second strip inner ends for selectively longitudinally advancing and retracting said first and second strips on said board;

f. guide means engaging said first and second strips to maintain at least the outwardly advanced portions thereof in closely spaced relation so that substantially longitudinal advancement of the respective strips can be effected with the respective advancing and retracting means without substantial outward bulging of either of said strips, whereby said interconnected ends can be directed to engage said game element through the independent selective advancement and retraction of said strips.

2. The device of claim 1, further comprising means attached to said interconnected outer ends for securing said game element thereto.

3. In the device of claim 2, said game board further characterized as having a plurality of spaced upstanding labyrinth elements thereon which cooperate to define a labyrinth structure on said board, said game element securing means being directable through said labyrinth structure to said game element.

4. In the device of claim 3, said guide means comprising said labyrinth elements which engage said strips to maintain them in closely spaced relation as said strips are directed through said labyrinth structure.

5. The device of claim 4, further comprising a base at each end of said board, first and second advancing and retracting means on each of said bases, and first and second strips attached to each of said first and second advancing and retracting means.

6. In the device of claim 2, said game element comprising a magnetically attractive ball, said game element securing means comprising a magnet.

7. In the device of claim 3, said game element further characterized as being magnetically attractive and spherical, said game element securing means comprising a magnet, said board further characterized as having a plurality of shallow recesses therein, said game element being receivable in one of said recesses and being transportable therefrom by said magnet.

8. In the device of claim 1, said first and second advancing and retracting means comprising first and second dial elements, respectively, rotatably mounted on said base, said first strip being attached to said first dial element and being coilable and uncoilable upon appropriate rotation of said first dial element, said second strip being attached to said second dial element and being coilable and uncoilable upon appropriate rotation of said second dial element.

9. In the device of claim 8, said base having first and second guide slots therein which extend from said first and second dial elements, respectively, and terminate adjacent each other at said board, said first and second strips traveling in said first and second slots, respectively.

10. In the device of claim 1, said outer ends of said first and second strips being integrally interconnected.

11. In the device of claim 10, said strips being of reduced cross section in the area where they are interconnected to provide increased flexibility in said strips at said interconnected area and to thereby enhance the directing of said game element securing means by the advancement and retraction of said strips.

12. The device of claim 11, further comprising means for automatically detaching said game element from said magnet when it is moved to a point adjacent said base.

13. In the device of claim 12, said base having an elongated recess therein adjacent said detaching means for receiving said game element after detachment thereof from said magnet.

14. The device of claim 1, further comprising downward retaining means for retaining said strips on said board.

* * * * *